US006872044B2

(12) United States Patent
Tsuruta

(10) Patent No.: US 6,872,044 B2
(45) Date of Patent: Mar. 29, 2005

(54) APPARATUS FOR AND METHOD OF MANUFACTURING SHEETS

(75) Inventor: Masao Tsuruta, Minamiashigara (JP)

(73) Assignee: Fuji Photo Film Co., Ltd., Kanagawa-Ken (JP)

( * ) Notice: Subject to any disclaimer, the term of this patent is extended or adjusted under 35 U.S.C. 154(b) by 0 days.

(21) Appl. No.: 10/291,604

(22) Filed: Nov. 12, 2002

(65) Prior Publication Data

US 2003/0075030 A1 Apr. 24, 2003

Related U.S. Application Data

(62) Division of application No. 09/822,839, filed on Apr. 2, 2001.

(30) Foreign Application Priority Data

Mar. 31, 2000 (JP) ..... 2000-099598
Nov. 30, 2000 (JP) ..... 2000-365821
Dec. 14, 2000 (JP) ..... 2000-379816

(51) Int. Cl.[7] ..... B26D 11/00; B26D 3/14

(52) U.S. Cl. ..... 414/788; 414/788.9; 414/790.2; 414/907; 83/29; 83/91; 83/422; 83/452; 83/948

(58) Field of Search ..... 83/29.86, 90, 91, 83/948, 452, 422; 414/788.1, 789.9, 790.2, 788.9, 788, 907; 53/520, 529, 540, 547

(56) References Cited

U.S. PATENT DOCUMENTS 2,520,252 A 8/1950 Mutchler
2,650,092 A * 8/1953 Wall ..... 271/18.1
3,343,334 A * 9/1967 Bode et al. ..... 83/277 X
3,595,370 A 7/1971 Fujishiro
3,642,151 A * 2/1972 Hayes ..... 414/790
4,093,069 A * 6/1978 Smolderen ..... 206/455
4,155,133 A 5/1979 Timson
4,573,863 A 3/1986 Picotte
4,842,573 A * 6/1989 Peter et al. ..... 493/412
4,848,762 A * 7/1989 Beery ..... 271/19
5,022,297 A * 6/1991 Hommes et al. ..... 83/35
5,209,629 A 5/1993 Rasmussen
5,353,576 A * 10/1994 Palamides et al. ..... 53/540
5,743,374 A 4/1998 Monsees
6,231,299 B1 * 5/2001 Newsome et al. ..... 414/788.9
6,409,462 B2 * 6/2002 Newsome et al. ..... 414/788.9

FOREIGN PATENT DOCUMENTS

DE 40 13 071 A1 * 6/1991
JP A 1-210298 8/1989

* cited by examiner

*Primary Examiner*—Clark F. Dexter
(74) *Attorney, Agent, or Firm*—Sughrue Mion, PLLC

(57) ABSTRACT

Sheets held by a sheet transfer mechanism are supplied from a supply unit to an aligning unit, and aligned with each other by the aligning unit. Thereafter, corners of the sheets are cut off by first and second cutting units, and then the sheets are vertically inverted by an inverting unit. Then, the sheets are turned into a given direction by a turning unit, and supplied to a discharge unit, from which the sheets are discharged.

8 Claims, 12 Drawing Sheets

APPARATUS FOR AND METHOD OF MANUFACTURING SHEETS

This is a divisional of application Ser. No. 09/822,839 filed Apr. 2, 2001; the disclosure of which is incorporated herein by reference.

BACKGROUND OF THE INVENTION

1. Field of the Invention

The present invention relates to an apparatus for and a method of manufacturing a stack of sheets by feeding the sheets and cutting off corners thereof.

2. Description of the Related Art

X-ray films or the like are produced by cutting a rolled photosensitive medium to successive given lengths as sheets, stacking the sheets, covering the sheets with a protective cover, sealing the sheets in a light-shielding pouch as a packaging material, and shipping the sealed sheets as a packaged product. The shipped packaged product is supplied to an image recording apparatus in which the sheets are delivered one by one by suction cups or the like and images are recorded thereon by a laser beam or the like.

Photosensitive mediums such as X-ray films are coated with an emulsion layer on their surfaces. When the coated surfaces of photosensitive mediums are attracted by the suction cups in the image recording apparatus, the coated surfaces tend to be damaged by the suction cups, possibly causing noise in images that are recorded on the photosensitive mediums. Furthermore, since X-ray films or similar sheets are produced from a roll of elongate film, the produced sheets have a tendency to roll. It is therefore important to take the rolling tendency of the sheets into account when the sheets are manufactured.

In the process of manufacturing sheets, it is necessary to turn them a certain angle in a horizontal plane or invert them, i.e., turn them upside down. However, a stack of many sheets is very heavy and cannot be handled efficiently. Nevertheless, the above operation needs to be performed quickly and reliably.

Furthermore, the stacked sheets that are flexible are required to be fed reliably between various steps of the process of manufacturing sheets.

Japanese laid-open patent publication No. 1-210298 discloses an apparatus in which the central region of the lower surface of a sheet is held by a narrow support having a concave support surface. In the disclosed apparatus, the sheet is curved by the narrow support for increased strength, and is fed in the curved state. The sheet can thus be fed without being flexed from one station to another, and can be transferred easily between the stations.

In the mechanism for feeding a stack of sheets, the delivery of sheets should be made reliably. For example, a stack of sheets needs to be fed without being displaced while being fed. It is desirable to feed sheets while giving certain strength to them regardless of their size, and also to hold and feed stacks of sheets reliably even if different number of sheets are contained in the stacks.

Sheets manufactured as packaged products have their sharp corners cut off into round corners for achieving easy handling and avoiding damage in use.

For example, in the apparatus disclosed in Japanese laid-open patent publication No. 1-210298, a plurality of square sheets are stacked and then aligned at their sides by an aligning unit, and the stacked sheets (hereinafter also referred to as "sheet stack") are fed to a first cutting unit where two corners are cut off, after which the sheet stack is fed to a second cutting unit where the other two corners are cut off.

In each of the first and second cutting units, the corners of the sheets are simultaneously cut off efficiently. However, while the sheet stack is being fed from the aligning unit to the first cutting unit and from the first cutting unit to the second cutting unit, if the sheets in the sheet stack are displaced out of position, then the following problems tend to arise:

If the sheet stack with the sheets displaced out of position is cut off in the first cutting unit or the second cutting unit, then the severed corners of the sheets may be shaped or positioned differently from each other. Since the two corners are simultaneously cut off in each of the first and second cutting units, these two corners may be shaped or positioned differently if the sheets are displaced out of position.

SUMMARY OF THE INVENTION

It is a general object of the present invention to provide an apparatus for manufacturing sheets efficiently with a reduced working burden by turning and inverting sheets in any desired direction.

Another object of the present invention is to provide an apparatus for and a method of manufacturing sheets by reliably feeding stacked sheets regardless of the number and size of stacked sheets.

Still another object of the present invention is to provide an apparatus for and a method of manufacturing sheets of high quality by cutting off corners of the sheets with high accuracy.

The above and other objects, features, and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
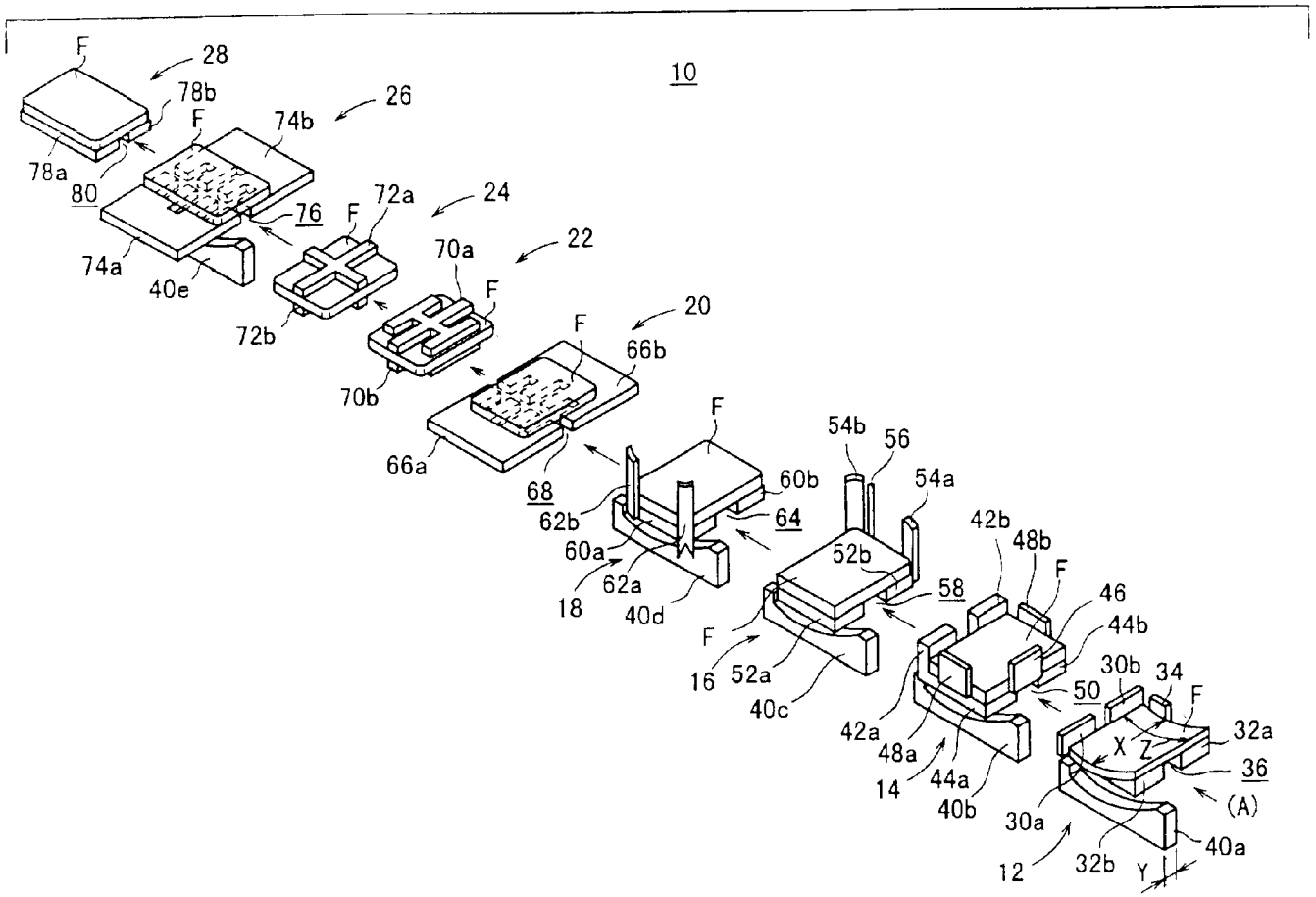
FIG. 1 is a schematic perspective view of a sheet manufacturing apparatus according to a first embodiment of the present invention.

FIG. 1 schematically shows an overall arrangement of a sheet manufacturing apparatus 10 according to a first embodiment of the present invention.

As shown in FIG. 1, the sheet manufacturing apparatus 10 comprises a supply unit 12, an aligning unit 14, a first cutting unit 16, a second cutting unit 18, a first transfer unit 20, an inverting unit 22, a turning unit 24, a second transfer unit 26, and a discharge unit 28 which are successively arranged in the feed direction indicated by the arrow (A) along which sheets are manufactured.

The supply unit 12 accommodates therein a stack of films F (sheets) produced by cutting a rolled photosensitive medium into predetermined lengths. The supply unit 12 has a pair of limiting guides 30*a*, 30*b* disposed on its front end in the feed direction, and a pair of support bases 32*a*, 32*b* having surfaces for holding the stack of films F thereon, the surfaces being curved in the feed direction. A limiting plate 34 for limiting a lateral position of the films F is displaceably disposed on a side of the support base 32*a*. The support bases 32*a*, 32*b* are laterally spaced from each other by a gap 36 left therebetween. A bucket 40*a* of a film transfer mechanism 38 shown in FIG. 2, details of which will be described later on, is retractably disposed in the gap 36.

The aligning unit 14 has a pair of limiting guides 42*a*, 42*b* disposed on its front end in the feed direction, and a pair of support bases 44*a*, 44*b* having flat surfaces for holding a stack of films F thereon. The aligning unit 14 also has a displaceable aligning plate 46 disposed in a position opposite to the limiting guides 42*a*, 42*b* and a pair of aligning plates 48*a*, 48*b* disposed on respective sides of the support bases 44*a*, 44*b*. The support bases 44*a*, 44*b* are laterally spaced from each other by a gap 50 left therebetween, and a bucket 40*b* is retractably disposed in the gap 50.

The first cutting unit 16 has a pair of support bases 52*a*, 52*b* having flat surfaces for holding a stack of films F thereon. The first cutting unit 16 also has a pair of cutters 54*a*, 54*b* disposed on a side of the support base 52*b* for cutting off two adjacent corners of the films F into arcuate corners. A notching blade 56 for producing notches in the films F is disposed between the cutters 54*a*, 54*b*. The support bases 52*a*, 54*b* are laterally spaced from each other by a gap 58 left therebetween, and a bucket 40*c* is retractably disposed in the gap 58.

The second cutting unit 18 has a pair of support bases 60*a*, 60*b* having flat surfaces for holding a stack of films F thereon. The second cutting unit 18 also has a pair of cutters 62*a*, 62*b* disposed on a side of the support base 60*a* for cutting off two adjacent corners of the films F into arcuate corners. The support bases 60*a*, 60*b* are laterally spaced from each other by a gap 64 left therebetween, and a bucket 40*d* is retractably disposed in the gap 64.

The first transfer unit 20 has a pair of transfer tables 66*a*, 66*b* for transferring films F to the inverting unit 22. The transfer tables 66*a*, 66*b* are laterally spaced from each other by a gap 68 left therebetween, and the bucket 40*d* can retractably be movable into the gap 68.

The inverting unit 22 has upper and lower sandwiching plates 70*a*, 70*b* for sandwiching and vertically inverting, i.e., turning upside down, films F that have been transferred by the first transfer unit 20.

The turning unit 24 has upper and lower sandwiching plates 72*a*, 72*b* for sandwiching films F that have been transferred from the inverting unit 22 by the second transfer unit 26 and turning the films F in the plane thereof.

The second transfer unit 26 has a pair of transfer tables 74*a*, 74*b* for transferring films F from the inverting unit 22 to the discharge unit 28. The transfer tables 74*a*, 74*b* are laterally spaced from each other by a gap 76 left therebetween, and a bucket 40*e* can retractably be movable into the gap 76.

The discharge unit 28 has a pair of support bases 78*a*, 78*b* which support the films F. The support bases 78*a*, 78*b* are laterally spaced from each other by a gap 80 left therebetween, and a bucket 40*e* can retractably be movable into the gap 80.

The film transfer mechanism 38 will be described below with reference to FIG. 2.

There are as many film transfer mechanisms 38 as the number of the buckets 40*a*–40*e* (support bodies), and these film transfer mechanisms 38 are associated with the buckets 40*a*–40*e*. As shown in FIG. 2, each film transfer mechanism 38 has a drive table 86 lying horizontally and a lifting and lowering cylinder 88 fixedly mounted on the drive table 86 for lifting and lowering the buckets 40*a*–40*e*. The film transfer mechanism 38 also has guide bars 92*a*, 92*b* extending vertically through respective sleeves 90*a*, 90*b* that are mounted on the drive table 86 on opposite sides of the lifting and lowering cylinder 88. The upper end of a piston rod 94 of the lifting and lowering cylinder 88 and the upper ends of the guide bars 92*a*, 92*b* are fixed to the lower surface of the buckets 40*a*–40*e*.

Each of the buckets 40*a*–40*e* has a concave curved surface 96 (concave support surface) on its upper surface for supporting films F thereon. The curved surface 96 serves to curve films F to impart rigidity thereto, so that the films F can reliably be fed by the buckets 40*a*–40*e*. The curved surface 96 has a horizontal width Y (see FIG. 1) in a horizontal direction perpendicular to the feed direction, which is slightly smaller than the widths of the gaps 68, 76.

Slide blocks 98*a*, 98*b* are fixedly mounted on an upper surface of the drive table 86. The slide blocks 98*a*, 98*b* are movable along a horizontal guide rail 100.

The drive table 86 is movable in the directions in which films F are fed in and out of the sheet manufacturing apparatus 10, by an actuator, not shown. There is a single drive table 86 associated with the buckets 40*a*–40*d* and extending through the film transfer mechanisms 38 for the buckets 40*a*–40*d*. Another drive table 86 is associated with the bucket 40*e* independently of the drive table 86 associated with the buckets 40*a*–40*d*.

A support member 104 is disposed on one side of the guide bar 92*b* with a bracket 102 interposed therebetween. The support member 104 can be adjusted in vertical position by a lifting and lowering cylinder 106 that is fixed to a lower end of the bracket 102. A clamp cylinder 110 is pivotally supported on a lower end of the support member 104 by a bracket 108. The clamp cylinder 110 has a piston rod 112 on which an end of a clamp member 114 (second presser) is pivotally supported. The clamp member 114 has an intermediate portion pivotally supported on an upper end of the support member 104 and an opposite end capable of holding an upper surface of films F placed on the buckets 40*a*–40*e*. A resilient member 115 is mounted on the opposite end of the clamp member 114 for protecting films F against damage.

Figure 3:
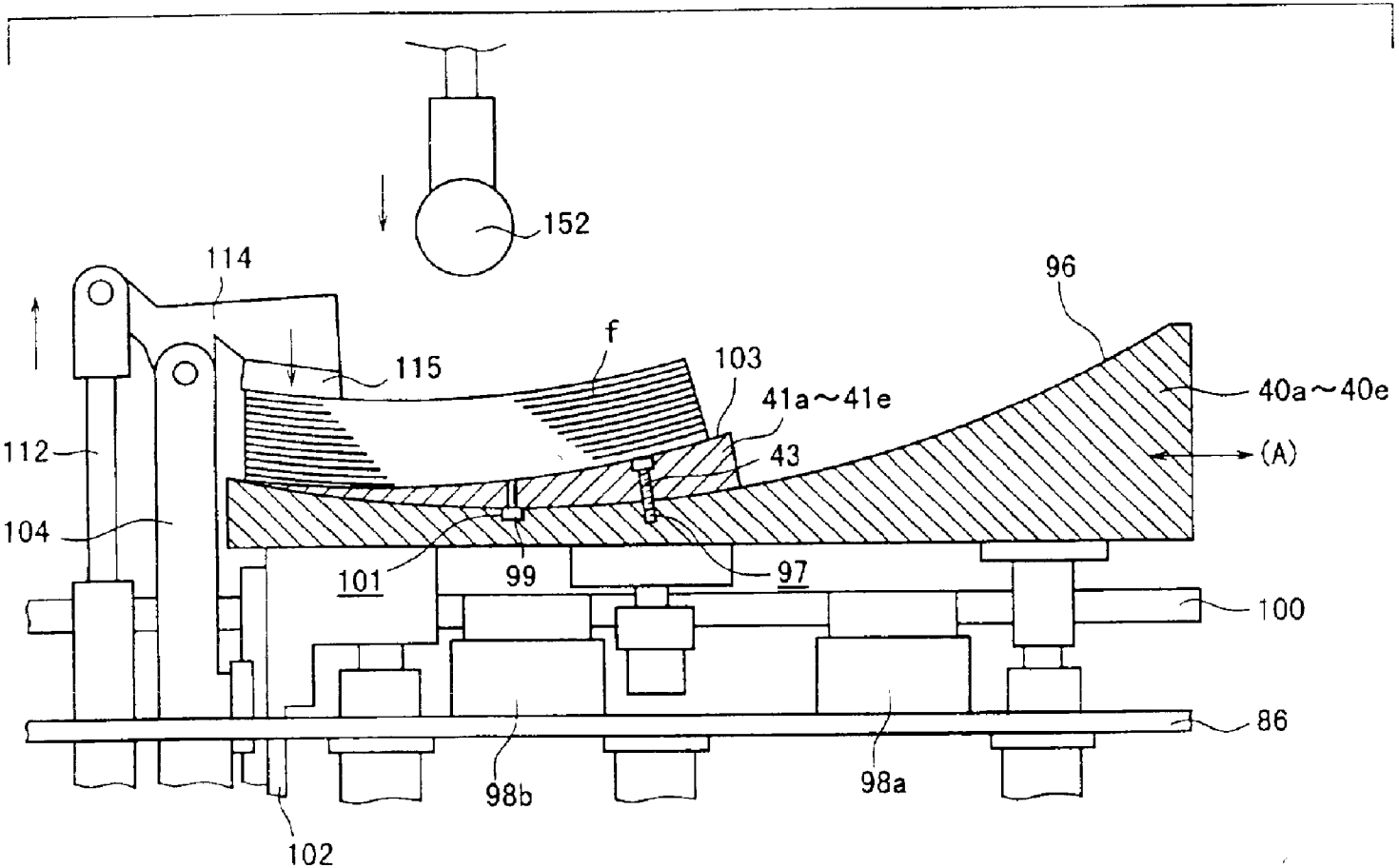
FIG. 3 is an elevational view, partly in cross section, showing the manner in which another bucket is mounted on the film transfer mechanism in the sheet manufacturing apparatus according to the first embodiment of the present invention.

A threaded hole 97 is defined centrally in a curved surface 96 of each of the buckets 40*a*–40*e*. A pin hole 101 for press-fitting a pin 99 (see FIG. 3) therein is also defined in the curved surface 96 at a position spaced a given distance from the threaded hole 97. As shown in FIG. 3, buckets 41*a*–41*e* (other support bodies) for supporting films f of a different size are removably mounted on the curved surfaces 96 of the respective buckets 40*a*–40*e*. The buckets 41*a*–41*e* are connected to the respective buckets 40*a*–40*e* by screws 43 threaded in the threaded holes 97, and positioned by fixing pins 99 that are press-fitted in the respective pin holes 101. The buckets 41*a*–41*e* have a width that is about one-half of the width of the buckets 40*a*–40*e*, across the feed direction in which films f are fed. The buckets 41*a*–41*e* have a curved surface 103 for supporting films f thereon. The radius of curvature of the curved surface 103 is smaller than the radius of curvature of the curved surface 96 of the buckets 40*a*–40*e* for supporting films F thereon.

Figure 4:
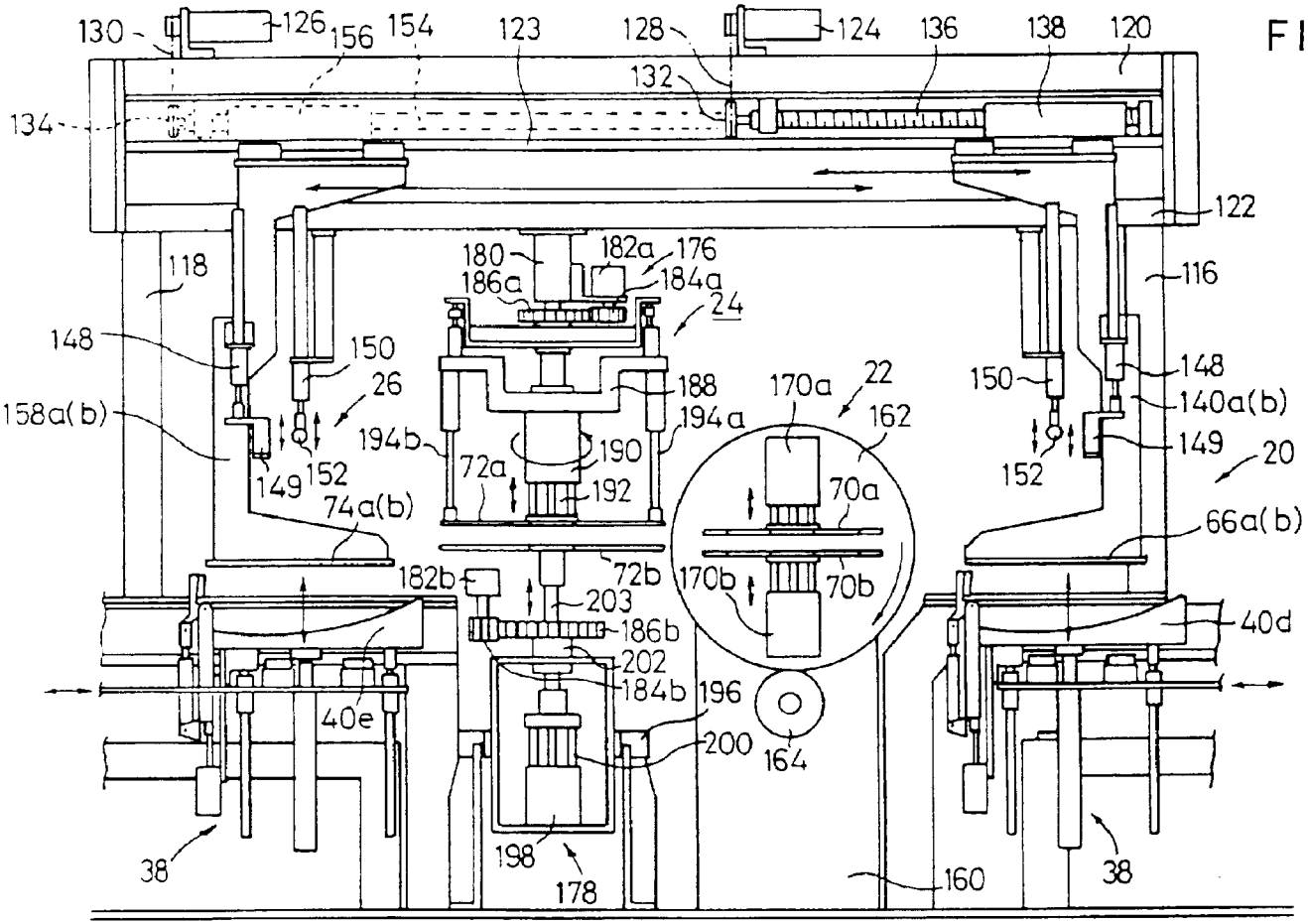
FIG. 4 is a side elevational view of a first transfer unit, an inverting unit, a turning unit, and a second transfer unit in the sheet manufacturing apparatus according to the first embodiment of the present invention.

FIG. 4 shows structural details of the first transfer unit 20, the inverting unit 22, the turning unit 24, and the second transfer unit 26 which are disposed between the second cutting unit 18 and the discharge unit 28.

Support columns 116, 118 are vertically disposed on sides of the first transfer unit 20 and the second transfer unit 26. Upper and lower beams 120, 122 extend between and are connected to upper ends of the support columns 116, 118, and a guide rail 123 extends between the upper and lower beams 120, 122. Displacing motors 124, 126 are fixedly mounted on the upper beam 120, and operatively coupled to respective sprockets 132, 134 by chains 128, 130.

Figure 5:
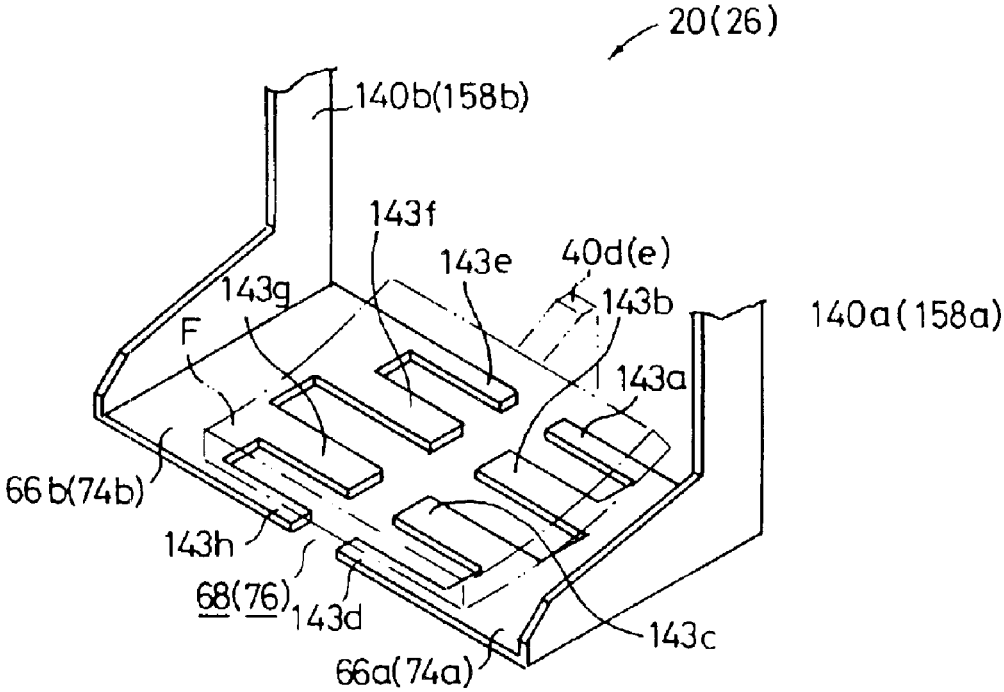
FIG. 5 is a fragmentary perspective view of the first and second transfer units in the sheet manufacturing apparatus according to the first embodiment of the present invention.

The sprocket 132 is connected to an end of a ball screw 136 that extends horizontally between the first transfer unit 20 and the inverting unit 22. A nut 138 is threaded over the ball screw 136 and coupled to brackets 140*a*, 140*b* of the first transfer unit 20 that are displaceable along the guide rail 123. As shown in FIG. 5, the brackets 140*a*, 140*b* have the transfer tables 66*a*, 66*b* on their lower ends. The transfer tables 66*a*, 66*b* are disposed in facing relation to each other with the gap 68 defined therebetween for inserting the bucket 40*d* therein, and have comb-toothed fingers 143*a*–143*h* for holding films F thereon.

A film presser 149 is joined to the brackets 140*a*, 140*b* by a pressing cylinder 148 for pressing an upper surface of films F that are being fed by the transfer tables 66*a*, 66*b*, 74*a*, 74*b*. A film presser bar 152 fixed to the beam 122 by a pressing cylinder 150 is disposed in a home position of the first transfer unit 20. The film presser bar 152 serves to correct films F from a curved state caused by the buckets 40*a*–40*e* and also to prevent films from popping out of the buckets 40*a*–40*e*.

The other sprocket 134 is connected to an end of a ball screw 154 that extends horizontally between the inverting unit 22 and the second transfer unit 26. A nut 156 is threaded over the ball screw 154 and coupled to brackets 158*a*, 158*b* of the second transfer unit 26 that are displaceable along the guide rail 123. Other structural details of the second transfer unit 26 are identical to those of the first transfer unit 20, and denoted by identical reference characters and will not be described in detail below.

Figure 6:
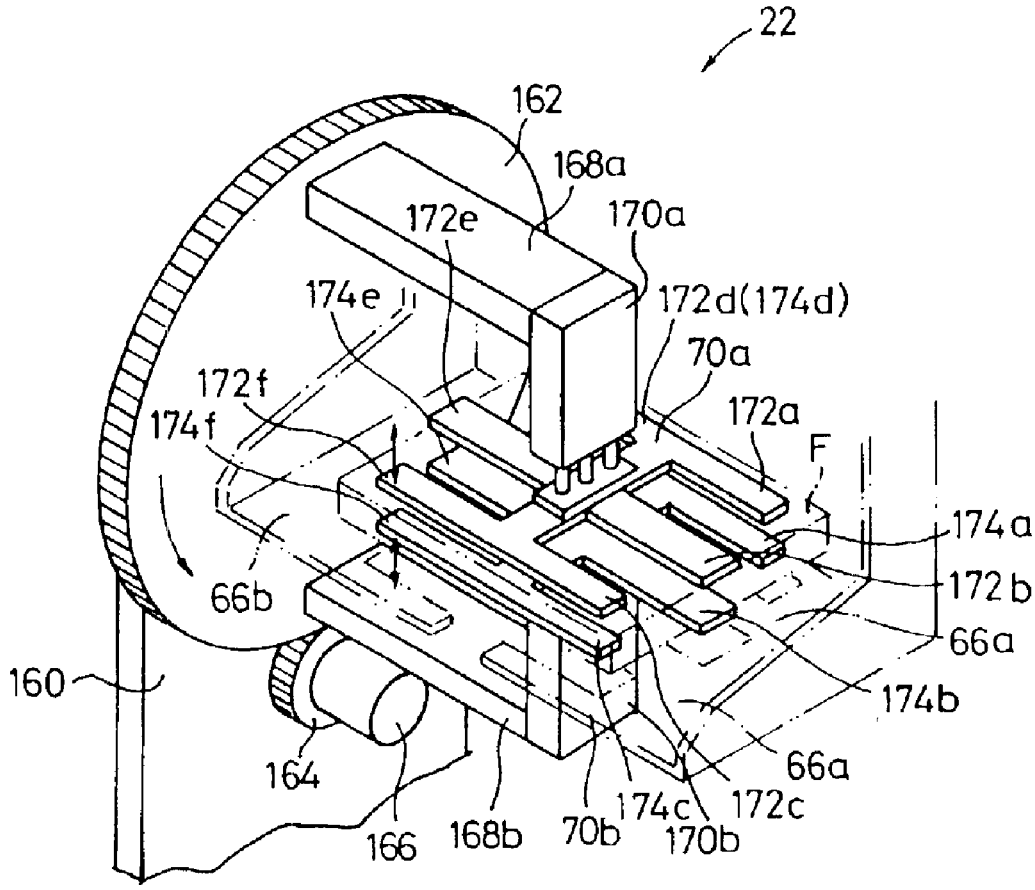
FIG. 6 is a fragmentary perspective view of the inverting unit in the sheet manufacturing apparatus according to the first embodiment of the present invention.

As shown in FIG. 6, the inverting unit 22 has a large gear 162 mounted on an upper end of a support column 160 and an inverting motor 166 operatively coupled to the large gear 162 by a small gear 164 meshing with the large gear 162. Opening and closing cylinders 170*a*, 170*b* are connected to the large gear 162 by respective upper and lower brackets 168*a*, 168*b*. The upper and lower sandwiching plates 70*a*, 70*b* are coupled respectively to the opening and closing cylinders 170*a*, 170*b*. The upper and lower sandwiching plated 70*a*, 70*b* have comb-toothed fingers 172*a*–172*f* and 174*a*–174*f* for holding films F which can pass through grooves between the comb-toothed fingers 143*a*–143*h* of the transfer tables 66*a*, 66*b* of the first transfer unit 20.

Figure 7:
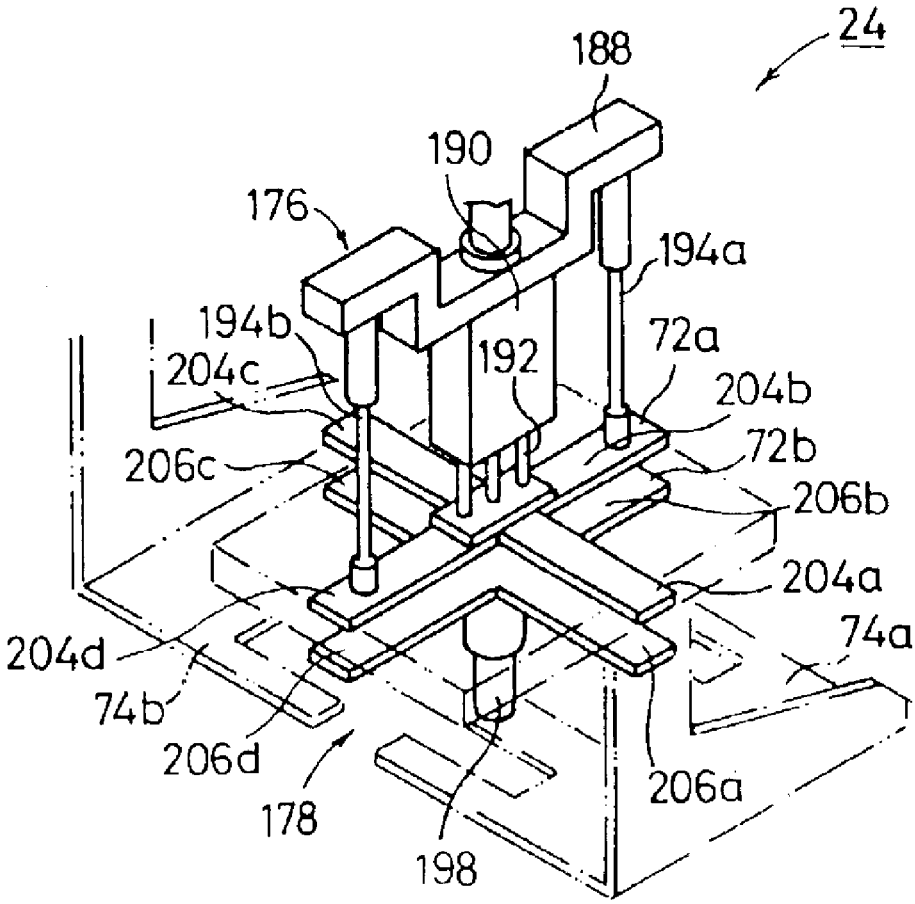
FIG. 7 is a fragmentary perspective view of the turning unit in the sheet manufacturing apparatus according to the first embodiment of the present invention.
Figure 8:
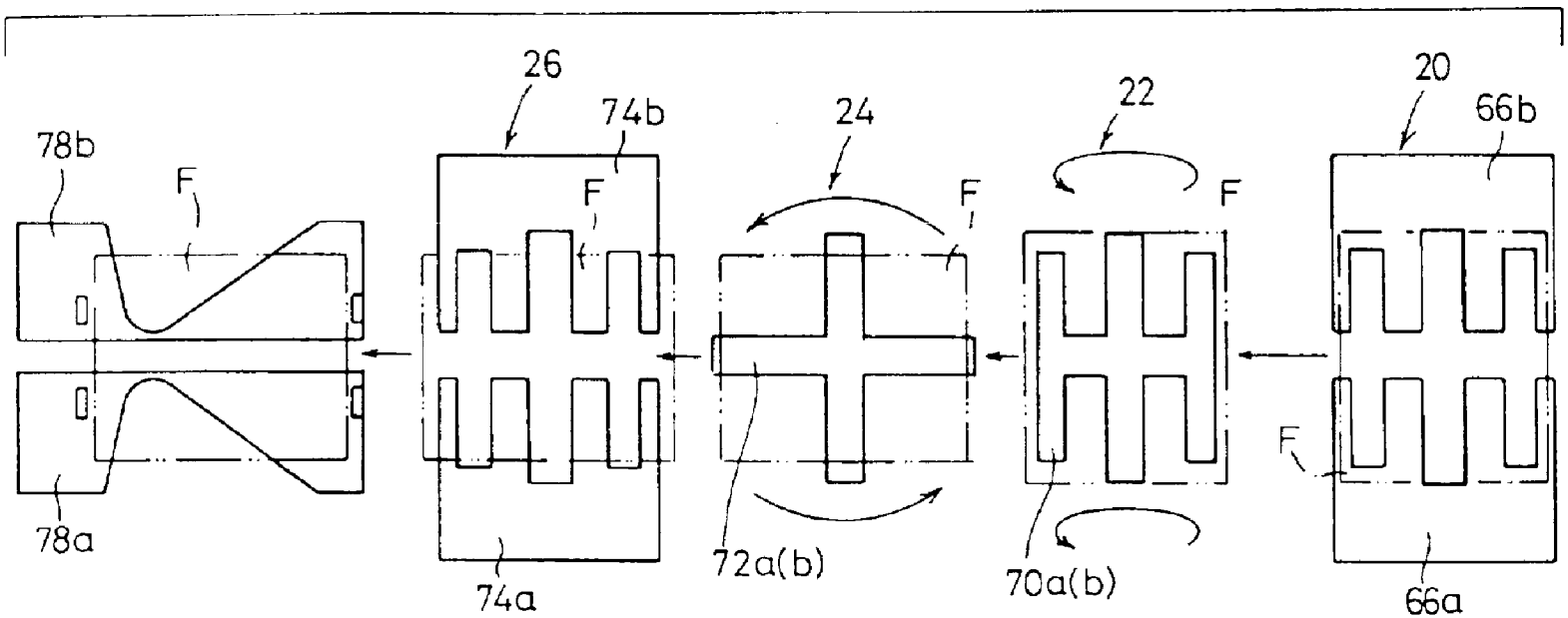
FIG. 8 is a view showing a processing sequence in the first transfer unit, the inverting unit, the turning unit, the second transfer unit, and a discharge unit in the sheet manufacturing apparatus according to the first embodiment of the present invention.

A shown in FIG. 7, the turning unit 24 basically comprises an upper turning mechanism 176 and a lower turning mechanism 178. The upper turning mechanism 176 comprises a bearing 180 (see FIG. 4) mounted downwardly on a central portion of the beam 122, a turning motor 182*a* fixedly mounted on the bearing 180, a gear 186*a* supported by the bearing 180 and held in mesh with a gear 184*a* of the turning motor 182*a*, a turntable 188 coupled to a shaft of the gear 186*a*, an opening and closing cylinder 190 fixed to a lower surface of the turntable 188, and the sandwiching plate 72*a* that is secured to piston rods 192 of the opening and closing cylinder 190. Guide bars 194*a*, 194*b* are vertically disposed between the turntable 188 and the sandwiching plate 72*a*.

The lower turning mechanism 178 comprises an opening and closing cylinder 198 supported on a base 196, a bearing 202 mounted on an upper end of piston rods 200 of the opening and closing cylinder 198, a turn shaft 203 supported by the bearing 202, and the sandwiching plate 72*b* that is mounted on an upper end of the turn shaft 203. The sandwiching plates 72*a*, 72*b* have respective fingers 204*a*–204*d* and 206*a*–206*d* that are arranged in a crisscross pattern. A gear 186*b* is fixed to the turn shaft 203, and a turning motor 182*b* is operatively coupled to the gear 186*b* by a gear 184*b* held in mesh with the gear 186*b*. The turning motor 182*a* of the upper turning mechanism 176 and the turning motor 182*b* of the lower turning mechanism 178 are energizable in synchronism with each other.

The sheet manufacturing apparatus 10 according to the first embodiment of the present invention is basically constructed as described above. Operation of the sheet manufacturing apparatus 10 will be described below.

For feeding films F with the buckets 40*a*–40*e*, films F are stacked on the support bases 32*a*, 32*b* in the supply unit 12. At this time, the front end of the films F in the feed direction indicated by the arrow (A) in FIG. 1 is limited by the limiting guides 30*a*, 30*b*, and one side of the films F is limited by the limiting plate 34. The films F are stacked in a curved state on the support bases 32*a*, 32*b*.

When a predetermined number of films F are supplied, the bucket 40*a* of the film transfer mechanism 38 is displaced upwardly into the gap 36 between the support bases 32*a*, 32*b*, and transfers the stacked films F to the next aligning unit 14.

Figure 2:
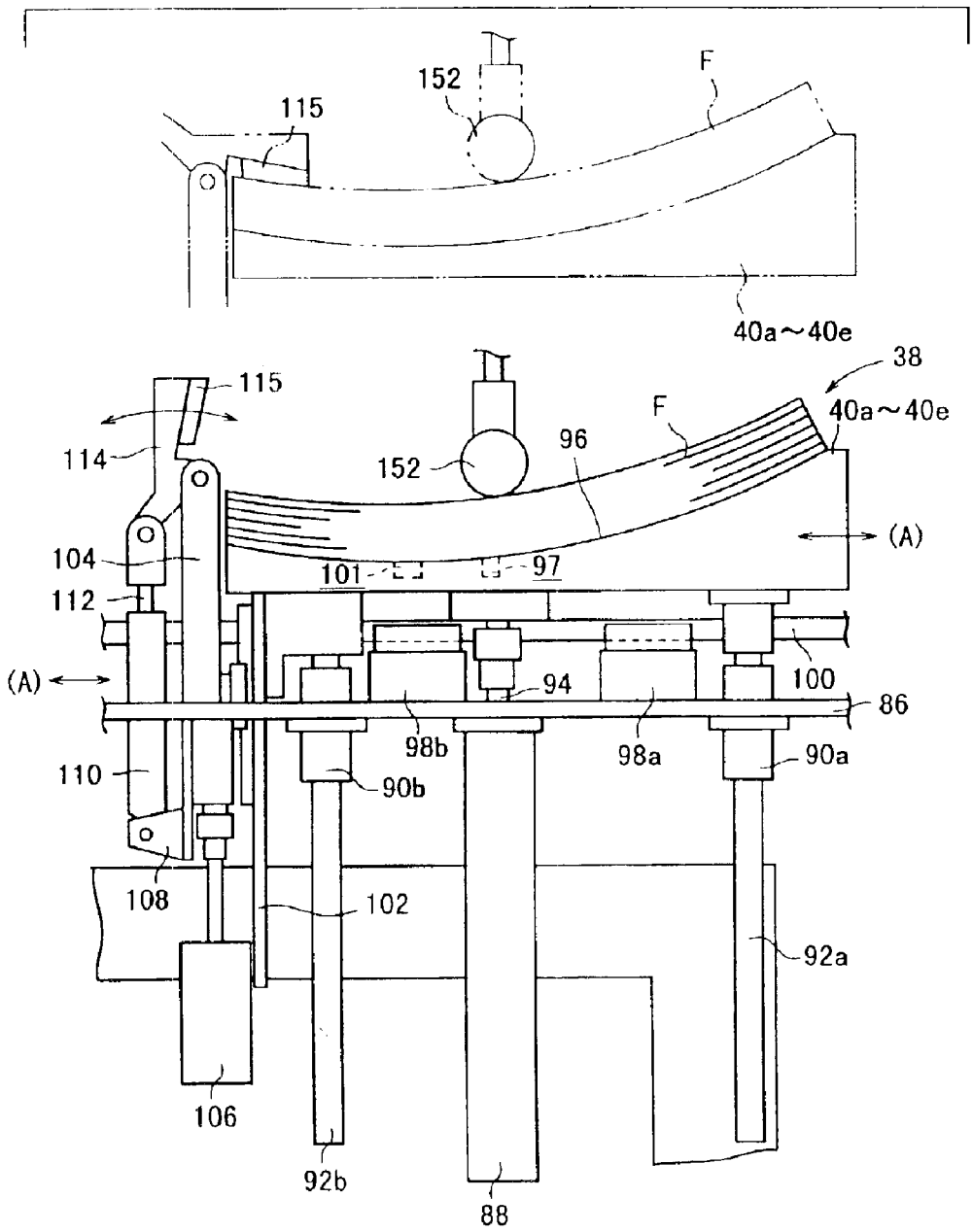
FIG. 2 is an elevational view of a film transfer mechanism in the sheet manufacturing apparatus according to the first embodiment of the present invention.

Specifically, as shown in FIG. 2, the film presser bar 152 is lowered to hold the films F together with the support bases 32*a*, 32*b*, after which the lifting and lowering cylinder 88 is actuated to lift the bucket 40*a* into the gap 36 between the support bases 32*a*, 32*b*. The lowermost film F of the film stack on the support bases 32*a*, 32*b* is supported on the curved surface 96 of the bucket 40*a*. Then, the clamp cylinder 110 is actuated to turn the clamp member 114 to cause the resilient member 115 thereon to press the uppermost film F of the film stack.

Since the stacked films F are pressed by the resilient member 115, the stacked films F are held in position for protection against being displaced while they are being fed. The distance between the curved surface 96 of the bucket 40*a* and the resilient member 115 can be adjusted as desired depending on the number of the stacked films F by actuating the lifting and lowering cylinder 106 (displacing means) to vertically move the support member 104. Therefore, the films F can be held adequately without suffering damage that would otherwise occur when sandwiched under an excessive pressure.

When the bucket 40*a* is elevated together with the film presser bar 152 from the above position, the films F are released from the limiting guides 30*a*, 30*b*. After the film presser bar 152 is spaced from the films F an actuator, not shown, is operated to move the drive table 86 in the feed direction, thereby feeding the films F to the next aligning unit 14. Although the width Y of the bucket 40*a* is smaller than the width X of the films F, since the films F are fed while being curved by the curved surface 96 of the bucket 40*a*, the opposite sides of the films F are prevented from sagging while they are being fed.

When the bucket 40*a* with the films F place thereon is moved to a position above the aligning unit 14, the lifting and lowering cylinder 88 of the film transfer mechanism 38 is actuated again to lower the bucket 40*a*. As a result, the films F are placed onto the support bases 44*a*, 44*b* of the aligning unit 14. Then, the front, rear, left, and right edges of the films F are aligned by the aligning plate 46 and the aligning plates 48*a*, 48*b*. The bucket 40*a* from which the films F have been placed onto the support bases 44*a*, 44*b* returns to a position for moving a next stack of films F in the supply unit 12 when the drive table 86 is displaced in a direction opposite to the feed direction.

The films F that have been aligned in the aligning unit 14 are then moved to the first cutting unit 16 by the bucket 40*b* and placed onto the support bases 52*a*, 52*b*. Thereafter, two corners of the films F are cut off into arcuate corners by the cutters 54*a*, 54*b*, and notches for confirming the direction of the films F are defined in a side of the films F by the notching blade 56.

Then, the films F are fed by the bucket 40*c* to the next second cutting unit 18 where the remaining two corners of the films F are cut off into arcuate corners by the cutters 62*a*, 62*b*. The stack of the films F whose corners have all been cut off is then fed to the next first transfer unit 20 by the bucket 40*d*.

A sequence of operation from the first transfer unit 20 to the discharge unit 28 will be described below with reference to FIGS. 4 through 8.

The bucket 40*d* with the films F held thereon which has been fed to the first transfer unit 20 enters the gap 68, and thereafter is lowered when the lifting and lowering cylinder 88 is actuated, as shown in FIG. 5. The films F are now placed on the comb-toothed fingers 143*a*–143*h* of the transfer tables 66*a*, 66*b* of the first transfer unit 20.

When the films F are to be transferred from each of the aligning unit 14, the first cutting unit 16, and the second cutting unit 18 to an adjacent unit, the films F are deformed from a planar state into a curved state. Specifically, the pressing cylinder 150 disposed above each of the buckets 40*b*–40*d* is actuated to lower the film presser bar 152 into abutment against a central portion of the films F. Then, the lifting and lowering cylinder 88 is actuated to lift the buckets 40*b*–40*d*. When the buckets 40*b*–40*d* are lifted a predetermined distance, the films F are curved by downward forces applied from the film presser bar 152 that abuts against the central portion of the films F and the curved surface 96 of the buckets 40*b*–40*d* which is held against the lower surface of the films F. Thereafter, the clamp cylinder 110 is actuated to cause the resilient member 115 on the end of the clamp member 114 to press the upper surface of the films F. The lifting and lowering cylinder 88 and the film presser bar 152 are lifted together to elevate the film F in the curved state by a predetermined distance. Thereafter, only the film presser bar 152 is further lifted away from the upper surface of the films F. Then, the drive table 86 is displaced downstream, and the buckets 40*b*–40*d* are lowered again. As a result, the stacked films F are placed onto the support bases 52*a*, 52*b* of the first cutting unit 16, the support bases 60*a*, 60*b* of the second cutting unit 18, and the transfer bases 66*a*, 66*b* of the first transfer unit 20.

When the stacked films F are placed onto the transfer bases 66*a*, 66*b* of the first transfer unit 20, the film presser 149 is lowered into abutment against the upper surface of the films F. Thereafter, the displacing motor 124 is energized to move the first transfer unit 20, which is holding the films F, toward the inverting unit 22.

In the inverting unit 22, the sandwiching plates 70*a*, 70*b* are waiting while being spaced apart from each other, and the transfer bases 66*a*, 66*b* of the first transfer unit 20 which are holding the films F enter between the sandwiching plates 70*a*, 70*b*. When the transfer bases 66*a*, 66*b* reach a predetermined position between the sandwiching plates 70*a*, 70*b*, the opening and closing cylinders 170*a*, 170*b* are actuated to move the sandwiching plates 70*a*, 70*b* toward each other. Since the comb-toothed fingers 172*a*–172*f* and 174*a*–174*f* of the sandwiching plates 70*a*, 70*b* are aligned with the gaps between the comb-toothed fingers 143*a*–143*h* of the transfer bases 66*a*, 66*b*, the sandwiching plates 70*a*, 70*b* sandwich the films F without interference with the transfer bases 66*a*, 66*b*.

When the sandwiching plates 70*a*, 70*b* sandwich the films F, the first transfer unit 20 returns in the direction opposite to the feed direction and waits for moving a next stack of films F. After the sandwiching plates 70*a*, 70*b* have sandwiched the films F, the inverting motor 166 is energized to cause the small gear 164 and the large gear 162 to turn the sandwiching plates 70*a*, 70*b* by 180°, thus inverting the films F, i.e., turning the films F upside down.

After the films F have been turned upside down, the second transfer unit 26 is moved to the inverting unit 22. As is the case with the first transfer unit 20, the films F are placed onto the transfer bases 74*a*, 74*b*. The second transfer unit 26 with the films F placed thereon is moved to the turning unit 24 by the displacing motor 126.

In the turning unit 24, the sandwiching plates 72*a*, 72*b* are waiting while being spaced apart from each other, and the transfer bases 74*a*, 74*b* of the second transfer unit 26 which are holding the films F enter between the sandwiching plates 72*a*, 72*b*. When the transfer bases 74*a*, 74*b* reach a predetermined position between the sandwiching plates 72*a*, 72*b*, the opening and closing cylinders 190, 198 are actuated to move the sandwiching plates 72*a*, 72*b* toward each other.

Since the comb-toothed fingers 204*a*–204*d* and 206*a*–206*d* of the sandwiching plates 72*a*, 72*b* are aligned with the gaps between the comb-toothed fingers 143*b*, 143*c* and between the comb-toothed fingers 143*g*, 143*f* of the transfer bases 74*a*, 74*b*, the sandwiching plates 72*a*, 72*b* sandwich the films F without interference with the transfer bases 74*a*, 74*b*.

After the films F have been sandwiched in the turning unit 24, the turning motors 182*a*, 182*b* are energized to cause the gears 184*a*, 184*b* and 186*a*, 186*b* to turn the sandwiching plates 72*a*, 72*b* by 90°. As a result, the films F are oriented in a given direction.

After the films F have been turned, the opening and closing cylinders 190, 198 are retracted away from each other to transfer the films F again onto the transfer bases 74*a*, 74*b* of the second transfer unit 26. The second transfer unit 26 which has received the films F is displaced to its home position shown in FIG. 4 by the displacing motor 126.

Then, the bucket 40*e* of the film transfer mechanism 38 which has been waiting below the second transfer unit 26 is lifted into the gap 76, thus holding the films F. The films F have the upper central surface pressed by the film presser bar 152 and hence are curved by and placed on the bucket 40*e*, in the same manner as when they were handled in the aligning unit 14, the first cutting unit 16, and the second cutting unit 18. Thereafter, the bucket 40*e* is displaced to the discharge unit 28, and places the films F onto support bases 78*a*, 78*b*. The films F placed on the support bases 78*a*, 78*b* are then fed to a next packaging process.

The sheet manufacturing apparatus 10 according to the first embodiment does not place a heavy burden on the workers, but allows stacks of films F to be inverted and turned reliably and easily.

In the first embodiment, the turning unit 24 is disposed between the inverting unit 22 and the second transfer unit 26. However, the discharge unit 28 which is in a final stage of the sheet manufacturing apparatus 10 may have a function to turn stacks of films F.

Figure 9:
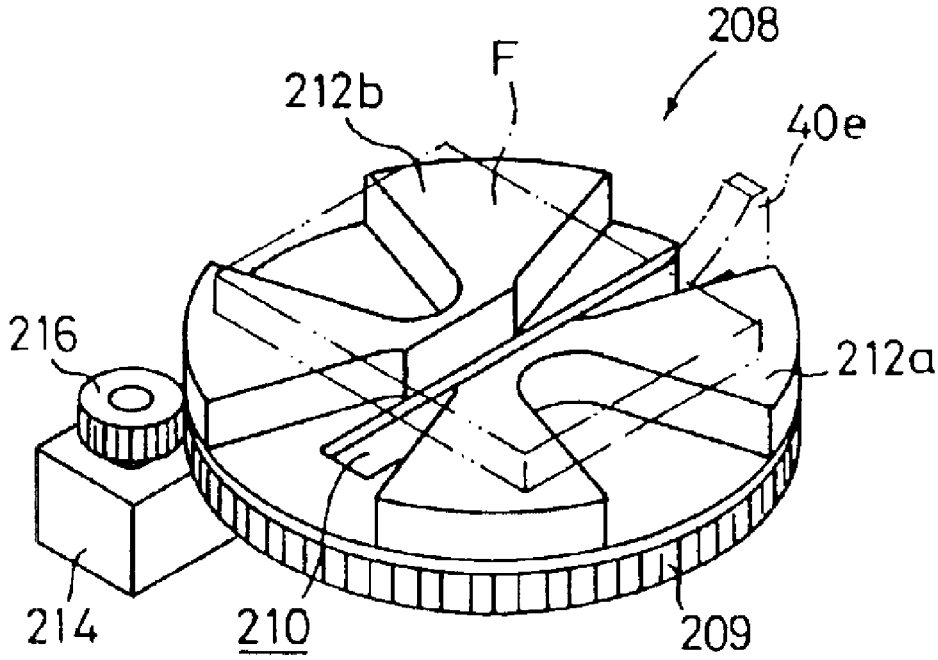
FIG. 9 is a perspective view of a turning discharge unit according to a modification for use in the sheet manufacturing apparatus according to the first embodiment of the present invention.

FIG. 9 shows a turning discharge unit 208 according to such a modification. As shown in FIG. 9, the turning discharge unit 208 comprises a turning gear 209 having a gap 210 defined therein for introducing the bucket 40*e* therein and a pair of support bases 212*a*, 212*b* disposed on the turning gear 209. The turning gear 209 is held in mesh with a gear 216 mounted on the drive shaft of a turning motor 214.

When films F are placed from the bucket 40*e* onto the support bases 212*a*, 212*b* of the turning discharge unit 208, the turning motor 214 is energized to cause the gear 216 and the turning gear 209 to turn the support bases 212*a*, 212*b* to turn the film F into a given direction. Then, the films F are discharged from the turning discharge unit 208 to a next process.

If the sheet manufacturing apparatus 10 incorporates the turning discharge unit 208 thus constructed, then the sheet manufacturing apparatus 10 has a feed path of reduced length for feeding films F.

In the sheet manufacturing apparatus 10 according to the first embodiment, the films F are fed in a curved state between the various units or steps.

If the radius of curvature of the curved surface 96 of each of the buckets 40*a*–40*e* is set to 60 cm, then it is possible to well feed films F having sizes Z×X from 18 cm×24 cm to 35 cm×43 cm, except films F having a size Z×X of 18 cm×43 cm, where Z represents the width of the films F in the feed direction and X represents the width of the films F in the direction perpendicular to the feed direction.

In the first embodiment, if the radius of curvature of the curved surface 103 of each of the buckets 41*a*–41*e* ranges from 30 cm to 40 cm, which is different from the radius of curvature of the curved surface 96, then it is possible to well feed films f having a size Z×X of 18 cm×43 cm, i.e., films f which are elongate in the direction perpendicular to the feed direction.

For feeding such elongate films f in the first embodiment, the pins 99 are press-fitted into the pin holes 101 in the buckets 40*a*–40*e*, and thereafter the buckets 41*a*–41*e* are fastened to the curved surfaces 96 of the buckets 40*a* 40*e* by the screws 43. Then, the films f are held on the curved surfaces 103 of the buckets 41*a*–41*e*. At this time, the films f are well held by the curved surfaces 103 whose radius of curvature is set depending on the width Z in the feed direction, and fed to a desired unit or step.

Figure 10:
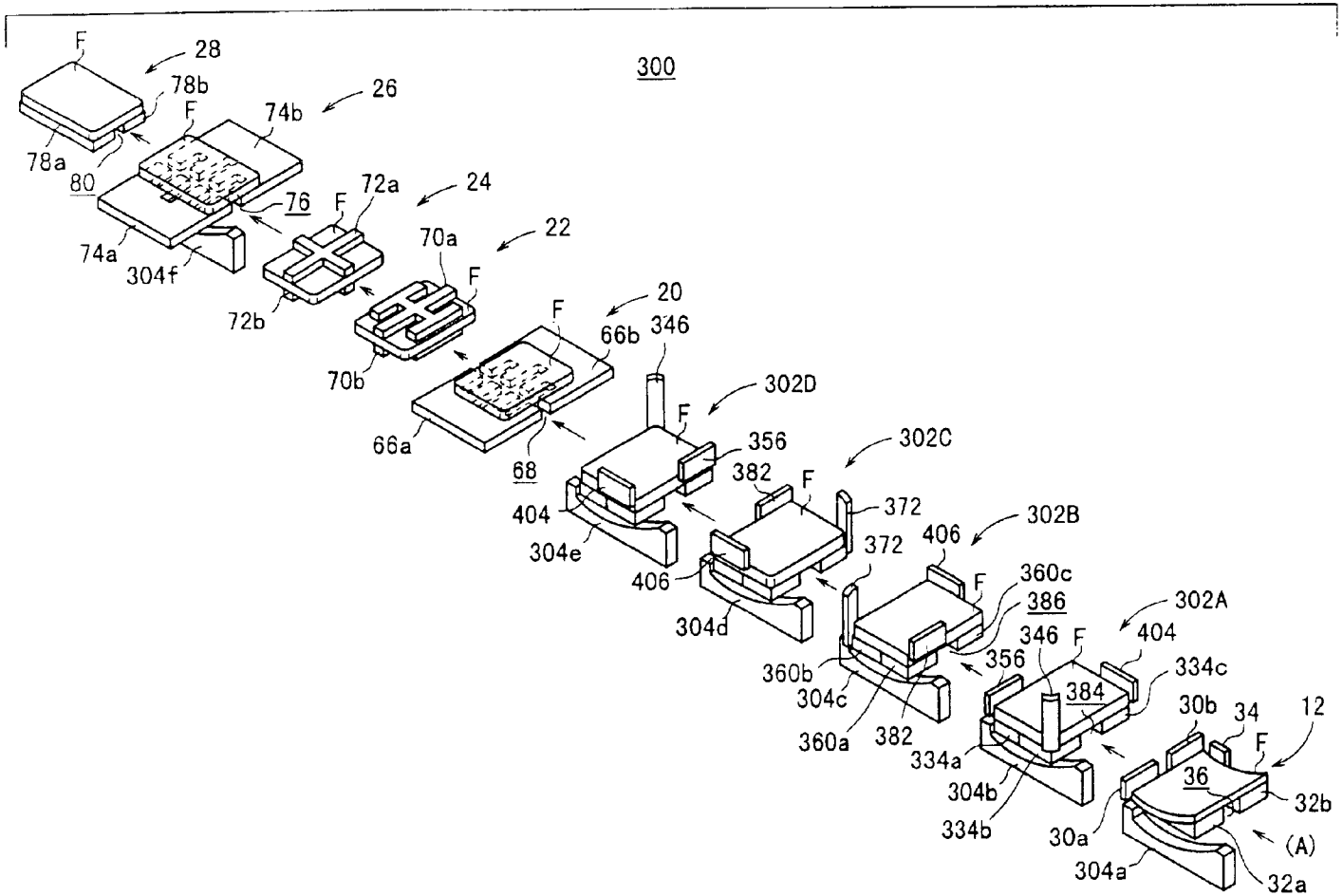
FIG. 10 is a schematic perspective view of a sheet manufacturing apparatus according to a second embodiment of the present invention.

FIG. 10 schematically shows a sheet manufacturing apparatus 300 according to a second embodiment of the present invention. Those parts of the sheet manufacturing apparatus 300 which are identical to those of the sheet manufacturing apparatus 10 according to the first embodiment are denoted by identical reference characters, and will not be described in detail below.

The sheet manufacturing apparatus 300 comprises a supply unit 12, a first cutting unit 302A, a second cutting unit 302B, a third cutting unit 302C, a fourth cutting unit 302D, a first transfer unit 20, an inverting unit 22, a turning unit 24, a second transfer unit 26, and a discharge unit 28 which are successively arranged in the feed direction indicated by the arrow (A) along which sheets are manufactured.

The first cutting unit 302A, the second cutting unit 302B, the third cutting unit 302C, and the fourth cutting unit 302D serve to cut first, second, third, and fourth corners, respectively, of films F into arcuate corners. Between the first through fourth cutting units 302A–302D, films F are fed by buckets 304*a*–304*e* of film transfer mechanisms 38. A bucket 304*f* is disposed in the second transfer unit 26.

Figure 11:
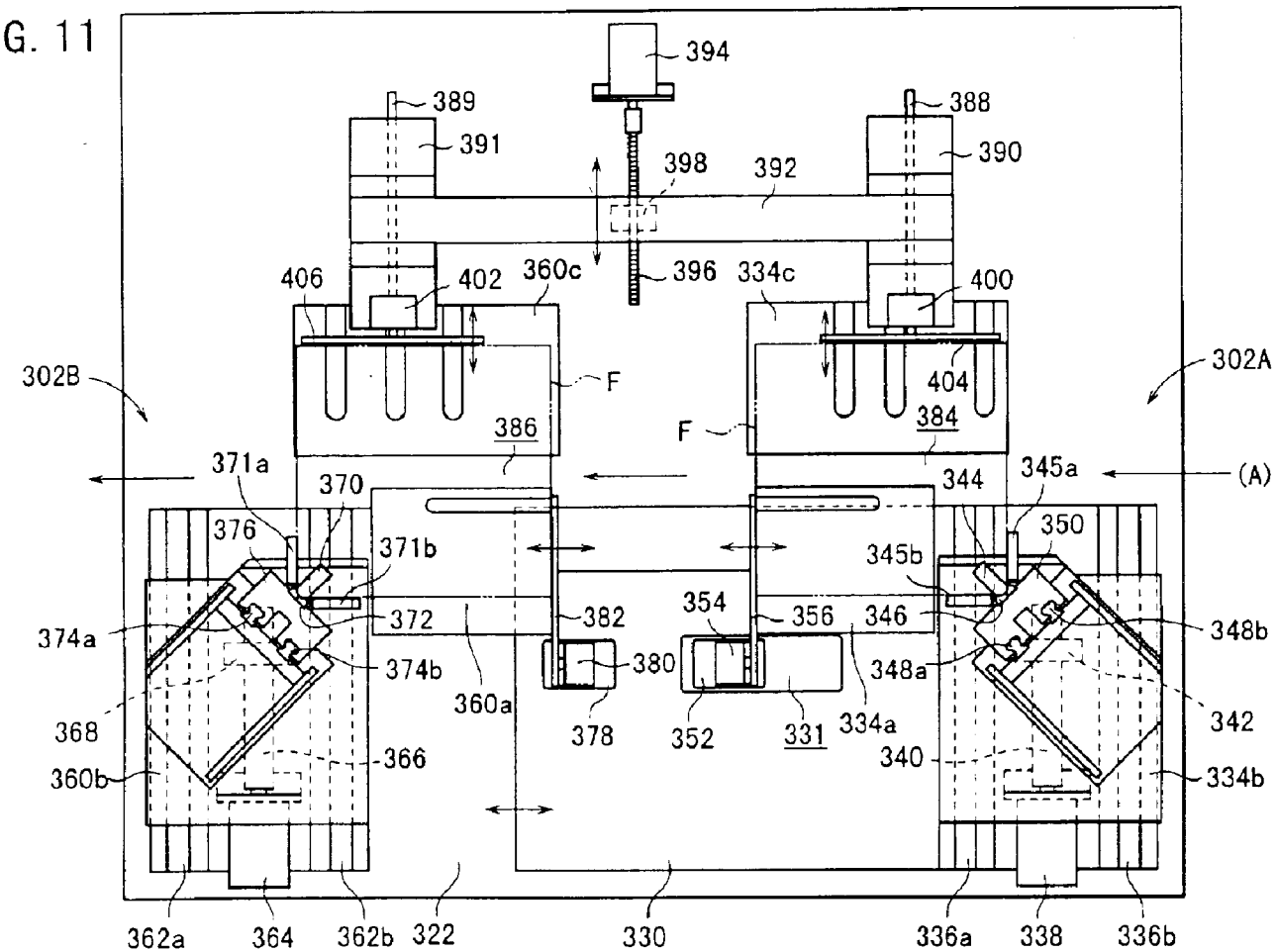
FIG. 11 is a plan view of a first cutting unit and a second cutting unit in the sheet manufacturing apparatus according to the second embodiment of the present invention.
Figure 12:
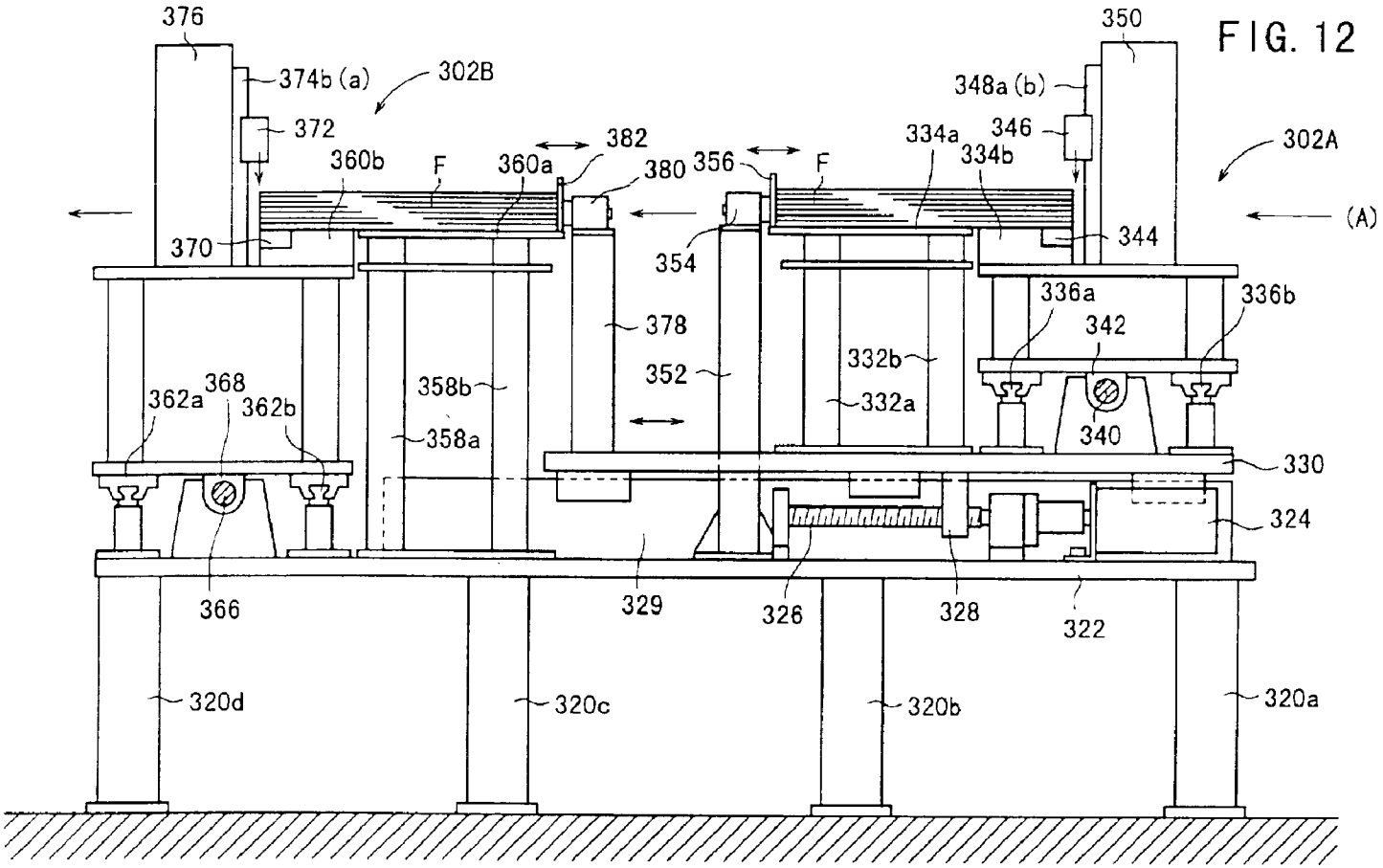
FIG. 12 is a side elevational view of the first cutting unit and the second cutting unit in the sheet manufacturing apparatus according to the second embodiment of the present invention.

FIGS. 11 and 12 show the first cutting unit 302A and the second cutting unit 302B in plan and side elevation, respectively. The third cutting unit 302C is identical in structure to the second cutting unit 302B, and the fourth cutting unit 302D is identical in structure to the first cutting unit 302A. The parts of the third and fourth cutting units 302C, 302D are denoted by reference characters identical to those of the second and first cutting units 302B, 302A, and will not be described in detail below.

In the first cutting unit 302A, a drive motor 324 is fixedly mounted on a plate 322 that is supported on support columns 320*a*–320*d*. To the drive motor 324, there is connected a feed screw 326 threaded through a nut 328 connected to a slide table 330 that is displaceable along a guide member 329 in the feed direction in which films F are fed.

A support base 334*a* for supporting films F is disposed on the slide table 330 by support columns 332*a*, 332*b*. The slide table 330 supports thereon guide rails 336*a*, 336*b* that extend horizontally perpendicularly to the feed direction. A support base 334*b* for supporting films F is disposed on the guide rails 336*a*, 336*b*. A drive motor 338 is fixed to the slide table 330 and connected to a feed screw 340 that is threaded through a nut 342 connected to the support base 334*b*. Therefore, the support base 334*b* is displaceable along the guide rails 336*a*, 336*b* horizontally perpendicularly to the feed direction.

The support base 334*b* supports thereon a lower blade 344 and an upper blade 346 for cutting off first corners of films F into arcuate corners. The lower blade 344 is fixed to the support base 334*b*, and fixed guides 345*a*, 345*b* for receiving films F are disposed one on each side of the lower blade 344. The upper blade 346 is fixed to an upper blade holder 350 that is vertically movable along guide rails 348*a*, 348*b* vertically mounted on the support base 334*b* by an actuator, not shown.

A support column 352 is vertically mounted on the plate 322 and extends through an oblong hole 331 defined in the slide table 330. A limiting guide 356 displaceable by a cylinder 354 is mounted on an upper end of the support column 352. The limiting guide 356 is disposed on a side of the support base 334*a* for limiting a downstream position of films F in the feed direction.

In the second cutting unit 302B, a support base 360*a* for supporting films F is disposed on the plate 322 by support columns 358*a*, 358*b*. The plate 322 supports thereon guide rails 362*a*, 362*b* that extend horizontally perpendicularly to the feed direction. A support base 360*b* for supporting films F is mounted on the guide rails 362*a*, 362*b*. A drive motor 364 is fixed to the plate 322 and connected to a feed screw 366 that is threaded through a nut 368 connected to the support base 360*b*. Therefore, the support base 360*b* is displaceable along the guide rails 362*a*, 362*b* horizontally perpendicularly to the feed direction.

The support base 360*b* supports thereon a lower blade 370 and an upper blade 372 for cutting off second corners of films F into arcuate corners. The lower blade 370 is fixed to the support base 360*b*, and fixed guides 371*a*, 371*b* for receiving films F are disposed one on each side of the lower blade 370. The upper blade 372 is fixed to an upper blade holder 376 that is vertically movable along guide rails 374*a*, 374*b* vertically mounted on the support base 360*b* by an actuator, not shown.

A support column 378 is vertically mounted on an end of the slide table 330 on the plate 322 near the second cutting unit 302B. A limiting guide 382 displaceable by a cylinder 380 is mounted on an upper end of the support column 378. The limiting guide 382 is disposed on a side of the support base 360*a* for limiting an upstream position of films F in the feed direction.

A support base 334*c* for supporting films F is disposed on the plate 322 and spaced by a gap 384 from the support bases 334*a*, 334*b* of the first cutting unit 302A in confronting relation thereto. Films F are supported on the support bases 334*a*–334*c* in the first cutting unit 302A. Similarly, a support base 360*c* for supporting films F is disposed on the plate 322 and spaced by a gap 386 from the support bases 360*a*, 360*b* of the second cutting unit 302B. Films F are supported on the support bases 360*a*–360*c* in the second cutting unit 302B.

Slide members 390, 391 are mounted on respective guide rails 388, 389 disposed on the plate 322 on sides of the support bases 334*c*, 360*c* and extending in the direction perpendicular to the feed direction. The slide members 390, 391 are interconnected by a beam 392. A drive motor 394 is disposed on the plate 322 between the guide rails 388, 389 and connected to a feed screw 396 that is threaded through a nut 398 fixed to a central portion of the beam 392. Therefore, the slide members 390, 391 are displaceable toward the support bases 334*c*, 360*c* by the drive motor 394.

Limiting guides 404, 406 that can be displaced by respective cylinders 400, 402 are mounted on respective upper ends of the slide members 390, 391. The limiting guide 404 is disposed on a side of the support base 334*c* of the first cutting unit 302A for limiting the position of a side of films F in a direction perpendicular to the limiting guide 356. Likewise, the limiting guide 406 is disposed on a side of the support base 360*c* of the second cutting unit 302B for limiting the position of a side of films F in a direction perpendicular to the limiting guide 382.

The sheet manufacturing apparatus 300 according to the second embodiment of the present invention is basically constructed as described above. Operation of the sheet manufacturing apparatus 300 will be described below.

After a plurality of films F have been stacked in the supply unit 12, the films F are fed to the next first cutting unit 302A by the bucket 304*a*. The bucket 304A with the films F placed thereon is lowered from above the first cutting unit 302A through the gap 384. As a result, the films F are transferred onto the flat support bases 334*a*–334*c* of the first cutting unit 302A.

In the first through fourth cutting units 302A–302D, the limiting guides 356, 382, 404, 406, the lower blades 344, 370, and the upper blades 346, 372 have been adjusted in position depending on the size of the films F that are fed.

Specifically, when the drive motor 324 shown in FIG. 12 is energized, the feed screw 326 is rotated about its own axis, causing the cut 328 to displace the slide table 330 in the feed direction indicated by the arrow (A). When the slide table 330 is displaced, the support bases 334*a*, 334*b*, the lower blade 344, and the upper blade 346 of the first cutting unit 302A are displaced in the feed direction. The first cutting unit 302A is now adjusted in size in the feed direction, using as a reference the first corner to be cut off by the lower blade 344 and the upper blade 346.

When the slide table 336 is displaced, the limiting guide 382 of the second cutting unit 302B which is coupled to the end of the slide table 330 by the support column 378 is displaced in the feed direction. The second cutting unit 302B is now adjusted in size in the feed direction, using as a reference the second corner to be cut off by the lower blade 370 and the upper blade 372.

Then, the drive motors 338, 364 are energized to rotate the feed screws 340, 366 about their own axes, causing the cuts 342, 368 to displace the support bases 334*b*, 360*b* along the guide rails 336*a*, 336*b*, 362*a*, 362*b*. The lower blades 344, 346 of the first cutting unit 302A and the lower cutting blades 370, 372 of the second cutting blade 302B are displaced in the direction perpendicular to the feed direction indicated by the arrow (A), adjusting the lower blades 344, 346 and the upper blades 370, 372 in size with respect to the first and second corners of the films F.

When the drive motor 394 is energized, the feed screw 396 is rotated about its own axis, causing the nut 398 to move the beam 392 in the direction perpendicular to the feed direction. At this time, the limiting guides 404, 406 are displaced along the guide rails 388, 389 by the slide members 390, 391 fixed to the opposite ends of the beam 392, thereby adjusting the limiting guides 404, 406 in size with respect to sides of the films F near the third and fourth corners thereof.

Similarly, the sizes of the third cutting unit 302C and the fourth cutting unit 302D are adjusted with respect to the films F.

After the films F fed by the bucket 304*a* have been placed on the support bases 334*a*–334*c* of the first cutting unit 302A, the cylinder 354 is actuated to displace the limiting guide 356 upstream in the feed direction. The films F are now displaced toward the lower blade 344 and the upper blade 346 while their downstream sides are aligned by the limiting guide 356.

Then, the cylinder 400 is actuated to displace the limiting guide 404 in the direction perpendicular to the feed direction. The films F are now displaced toward the lower blade 344 and the upper blade 346 while their sides parallel to the feed direction are aligned by the limiting guide 404.

After the films F have thus been positioned, the upper blade 346 is lowered toward the lower blade 344 by the upper blade holder 350, cutting off the first corner of the films F. Since the first corner is cut off with the two perpendicular sides of the films F being aligned by the limiting guides 356, 404, the first corner of each of the films F can be cut off with high accuracy without being adversely affected by any positional displacement of the films F which may have occurred when they have been fed.

The films F with the first corner thus cut off are fed to the second cutting unit 302B by the bucket 304*b*, and placed on the support bases 360*a*–360*c*. The cylinder 380 is actuated to displace the limiting guide 382 downstream in the feed direction, displacing the films F toward the lower blade 370 and the upper blade 372 while their upstream side are aligned by the limiting guide 382.

Then, the cylinder 402 is actuated to displace the limiting guide 406 in the direction perpendicular to the feed direction. The films F are now displaced toward the lower blade 370 and the upper blade 372 while their sides parallel to the feed direction are aligned by the limiting guide 406.

After the films F have thus been positioned, the upper blade 372 is lowered toward the lower blade 370 by the upper blade holder 376, cutting off the second corner of the films F. Since the second corner is cut off with the two perpendicular sides of the films F being aligned by the limiting guides 382, 406, the second corner of each of the films F can be cut off with high accuracy without being adversely affected by any positional displacement of the films F which may have occurred when they have been fed.

The films F with the first and second corners thus cut off are fed successively to the third cutting unit 302C and the fourth cutting unit 302D by the buckets 304*c*, 304*d*, and the remaining third and fourth corners of the films F are cut off respectively in the third cutting unit 302C and the fourth cutting unit 302D.

The films F with the first through fourth corners thus cut off are fed are fed successively to the first transfer unit 20, the inverting unit 22, the turning unit 24, the second transfer unit 26, and the discharge unit 28 by the buckets 304*e*, 304*f*. Thereafter, the films F are fed from the discharge unit 28 to a next packaging process.

Although certain preferred embodiments of the present invention have been shown and described in detail, it should be understood that various changes and modifications may be made therein without departing from the scope of the appended claims.

What is claimed is:

1. A method of manufacturing a plurality of stacked sheets by feeding the sheets, comprising the steps of:

holding a first presser member in abutment against a central portion of an upper surface of stacked sheets;

pressing a support member having a concave support surface against a lower surface of said stacked sheets;

holding the upper surface of said stacked sheets with a second presser member which is adjustable to correspond to the thickness of said stacked sheets; and sandwiching and feeding said stacked sheets with said first presser member, said support member, and said second presser member wherein said first presser member, said second presser member and said support member move with said stacked sheets during at least a portion of the feeding.

2. The method of manufacturing according to claim 1, further comprising:

holding a third presser member in abutment against the upper surface of the stacked sheets.

3. The method of manufacturing according to claim 2, wherein the third presser member is operable to move in a translational direction toward and away from the upper surface of the stacked sheets.

4. The method of manufacturing according to claim 1, further comprising:

actuating a clamp cylinder so as to rotate the second presser member away from the upper surface of the stacked sheets.

5. The method of manufacturing according to claim 1, wherein the first presser member is operable to move in a translational direction toward and away from the upper surface of the stacked sheets.

6. The method of manufacturing according to claim 5, wherein the support member is operable to move in a translational direction toward and away from the lower surface of the stacked sheets.

7. The manufacturing method according to claim 1, wherein the support member bears the weight of the stacked sheets when pressed against the lower surface of the stacked sheets.

8. The method of manufacturing according to claim 1, wherein the support member is operable to move in a translational direction toward and away from the lower surface of the stacked sheets.

* * * * *